US010101080B2

(12) United States Patent
Willis et al.

(10) Patent No.: US 10,101,080 B2
(45) Date of Patent: Oct. 16, 2018

(54) DISPENSER WITH VESSEL IDENTIFICATION

(71) Applicant: Electrolux Home Products, Inc., Charlotte, NC (US)

(72) Inventors: Timothy Willis, Clemson, SC (US); Kurt Froehlich, Conegliano (IT)

(73) Assignee: Electrolux Home Products, Inc., Charlotte, NC (US)

( * ) Notice: Subject to any disclaimer, the term of this patent is extended or adjusted under 35 U.S.C. 154(b) by 914 days.

(21) Appl. No.: 13/971,946

(22) Filed: Aug. 21, 2013

(65) Prior Publication Data

US 2015/0053302 A1 Feb. 26, 2015

(51) Int. Cl.

| | |
|---|---|
| ***F25D 29/00*** | (2006.01) |
| ***F25D 23/12*** | (2006.01) |
| ***F25C 5/20*** | (2018.01) |

(52) U.S. Cl.

CPC ..... *F25D 29/00* (2013.01); *F25C 5/22* (2018.01); *F25D 23/126* (2013.01); *F25C 2400/10* (2013.01); *F25D 2600/06* (2013.01); *F25D 2700/06* (2013.01); *F25D 2700/08* (2013.01)

(58) Field of Classification Search

CPC .... F25C 2400/10; F25C 5/005; F25D 23/126; F25D 2600/06; F25D 29/00

USPC ..... 141/1, 83, 94, 104, 192, 198, 237, 351, 141/360; 62/389–400

See application file for complete search history.

(56) References Cited

U.S. PATENT DOCUMENTS

| | | | | |
|---|---|---|---|---|
| 5,050,777 | A * | 9/1991 | Buchser | 222/146.6 |
| 5,566,732 | A * | 10/1996 | Nelson | 141/94 |
| 6,572,016 | B2 * | 6/2003 | Saveliev et al. | 235/383 |
| 7,373,784 | B2 * | 5/2008 | Haskayne | 62/201 |

(Continued)

FOREIGN PATENT DOCUMENTS

| | | | |
|---|---|---|---|
| EP | 1371312 | A2 | 12/2003 |
| EP | 1637055 | A2 | 3/2006 |
| WO | 2009051346 | A2 | 4/2009 |

OTHER PUBLICATIONS

International Search Report and Written Opinion issued in Application No. PCT/US2014/051604 dated Nov. 17, 2014.

*Primary Examiner* — Timothy L Maust

(74) *Attorney, Agent, or Firm* — Pearne & Gordon LLP

(57) ABSTRACT

A refrigeration apparatus includes a dispenser for dispensing water or ice into a receiver vessel. The dispenser includes a dispense command input for receiving a dispense command from a user and a code reader for interpreting an identification code associated with the receiver vessel. At least one controller is operatively connected to the dispense command input to receive the dispense command, and to the code reader to receive a vessel identification based on the interpreted identification code. The at least one controller controls the dispensing. A memory is configured to store the vessel identification in association with a usage parameter for the vessel. The at least one controller determines whether water/ice has been previously dispensed into the receiver vessel. When the at least one controller has determined that water/ice has not been previously dispensed into the receiver vessel, the at least one controller causes the usage parameter to be stored in the memory, in association with the vessel identification, based on the dispense command received from the user.

11 Claims, 5 Drawing Sheets

(56) References Cited

U.S. PATENT DOCUMENTS

| | | | | |
|---|---|---|---|---|
| 7,617,850 | B1 * | 11/2009 | Dorney | 141/94 |
| 7,845,375 | B2 * | 12/2010 | Dorney | 141/94 |
| 8,127,805 | B2 | 3/2012 | Dorney | |
| 8,151,832 | B1 * | 4/2012 | Dorney | 141/94 |
| 2005/0029287 | A1 * | 2/2005 | Mobbs | 222/1 |
| 2006/0081653 | A1 * | 4/2006 | Boland et al. | 222/243 |
| 2009/0057341 | A1 * | 3/2009 | Girard et al. | 222/129.1 |
| 2009/0071567 | A1 * | 3/2009 | Cooper | 141/94 |
| 2011/0049180 | A1 * | 3/2011 | Carpenter et al. | 222/1 |
| 2011/0259033 | A1 * | 10/2011 | Froehlich | 62/344 |
| 2012/0104023 | A1 * | 5/2012 | Anselmino et al. | 222/1 |
| 2013/0092567 | A1 * | 4/2013 | Lok | 206/219 |
| 2013/0319017 | A1 * | 12/2013 | Meltzer et al. | 62/56 |
| 2014/0224375 | A1 * | 8/2014 | Willis | 141/1 |
| 2015/0053302 | A1 * | 2/2015 | Willis et al. | 141/1 |

* cited by examiner

DISPENSER WITH VESSEL IDENTIFICATION

CROSS-REFERENCE TO RELATED APPLICATIONS

Not applicable.

BACKGROUND OF THE INVENTION

Field of the Invention

The present invention relates generally to refrigeration appliances, and in particular to dispensing units associated with refrigeration appliances.

Description of Related Art

Modern refrigeration appliances, such as household refrigerators for example, often include as one of their features a dispensing unit for water and/or ice. Frequently, the dispensing unit is located within a recess in the exterior surface of a door of the appliance. The refrigeration appliance can take any one of a number of forms. For example, the refrigeration appliance can have freezer and fresh food compartments that are arranged side-by-side or the freezer compartment can be located above the fresh food compartment. In any case, separate doors can be provided for the freezer and fresh food compartments and a dispensing unit for water and/or ice can be located within the recess in the exterior of at least one of the doors.

Conventionally, the dispensing units can include at least an outlet for dispensing water and an outlet for dispensing ice. Associated with the water dispensing outlet can be an input device in the form of a lever, paddle, cradle, switch, or other actuating device that is pivotally attached to the rear of the dispensing unit. When water is to be dispensed, a glass or other vessel is pressed against the input device thereby operating a switch or sensor so as to complete an electrical circuit between a source of electrical power and a solenoid-operated valve connected to a source of water. The completion of the electrical circuit opens the solenoid-operated valve permitting the water to flow from the source of water to the water dispensing outlet.

BRIEF SUMMARY OF THE INVENTION

The following summary presents a simplified summary in order to provide a basic understanding of some aspects of the devices and methods discussed herein. This summary is not an extensive overview of the devices and methods discussed herein. It is not intended to identify critical elements or to delineate the scope of such devices and methods. Its sole purpose is to present some concepts in a simplified form as a prelude to the more detailed description that is presented later.

In accordance with another aspect of the present invention, provided is a refrigeration apparatus, comprising a fresh food compartment, a freezer compartment, and a dispenser configured to dispense at least one of water and ice into a receiver vessel. The dispenser comprises a dispense command input configured to receive a dispense command from a user and a code reader configured to interpret an identification code associated with the receiver vessel when the receiver vessel is located proximate the dispenser. At least one controller is operatively connected to the dispense command input to thereby receive the dispense command, and operatively connected to the code reader to thereby receive a vessel identification from the code reader based on the interpreted identification code. The at least one controller controls a dispensing of the at least one of water and ice. A memory is configured to store the vessel identification in association with a usage parameter for the receiver vessel. The at least one controller determines whether the at least one of water and ice has been previously dispensed into the receiver vessel. When the at least one controller has determined that the at least one of water and ice has not been previously dispensed into the receiver vessel, the at least one controller causes the usage parameter to be stored in the memory, in association with the vessel identification, based on the dispense command received from the user.

In accordance with another aspect of the present invention, provided is a refrigeration apparatus, comprising a fresh food compartment, a freezer compartment, and a dispenser configured to dispense water into a receiver vessel. The dispenser comprises a dispense command input configured to receive a dispense command from a user, and a code reader configured to interpret an identification code associated with the receiver vessel when the receiver vessel is located proximate the dispenser. A first controller is operatively connected to the dispense command input to thereby receive the dispense command, and operatively connected to the code reader to thereby receive a vessel identification from the code reader based on the interpreted identification code. A water line is in communication with the dispenser to supply the water to the dispenser. A valve is located along the water line. The refrigeration apparatus includes a second controller capable of bidirectional communications with the first controller. The second controller is operatively connected to the valve to control operations of the valve. A memory is configured to store the vessel identification in association with a usage parameter for the receiver vessel, the usage parameter including a volume. Either the first controller or the second controller determines whether water has been previously dispensed into the receiver vessel. When either the first controller or the second controller has determined that water has not been previously dispensed into the receiver vessel, either the first controller or the second controller causes the usage parameter to be stored in the memory, in association with the vessel identification, based on a volume of water manually dispensed using the dispense command input.

In accordance with one aspect of the present invention, provided is a method of dispensing water. A refrigeration apparatus is provided and includes a fresh food compartment, a freezer compartment, and a dispenser for dispensing water into a receiver vessel. An identification code associated with the receiver vessel is interpreted by the dispenser. The receiver vessel is identified based on the interpreted identification code. The refrigeration apparatus automatically determines whether water has been previously dispensed by the dispenser into the receiver vessel. A dispense command is received from a user for an arbitrary length of time. Upon determining that water has not been previously dispensed into the receiver vessel, water is dispensed into the receiver vessel for at least a portion of the arbitrary length of time, to thereby dispense a volume of water into the receiver vessel. The volume of water dispensed into the receiver vessel is determined. Both of a usage parameter and a vessel identification for the receiver vessel are stored in a memory, and the usage parameter includes said volume.

DETAILED DESCRIPTION OF THE INVENTION

Figure 1:
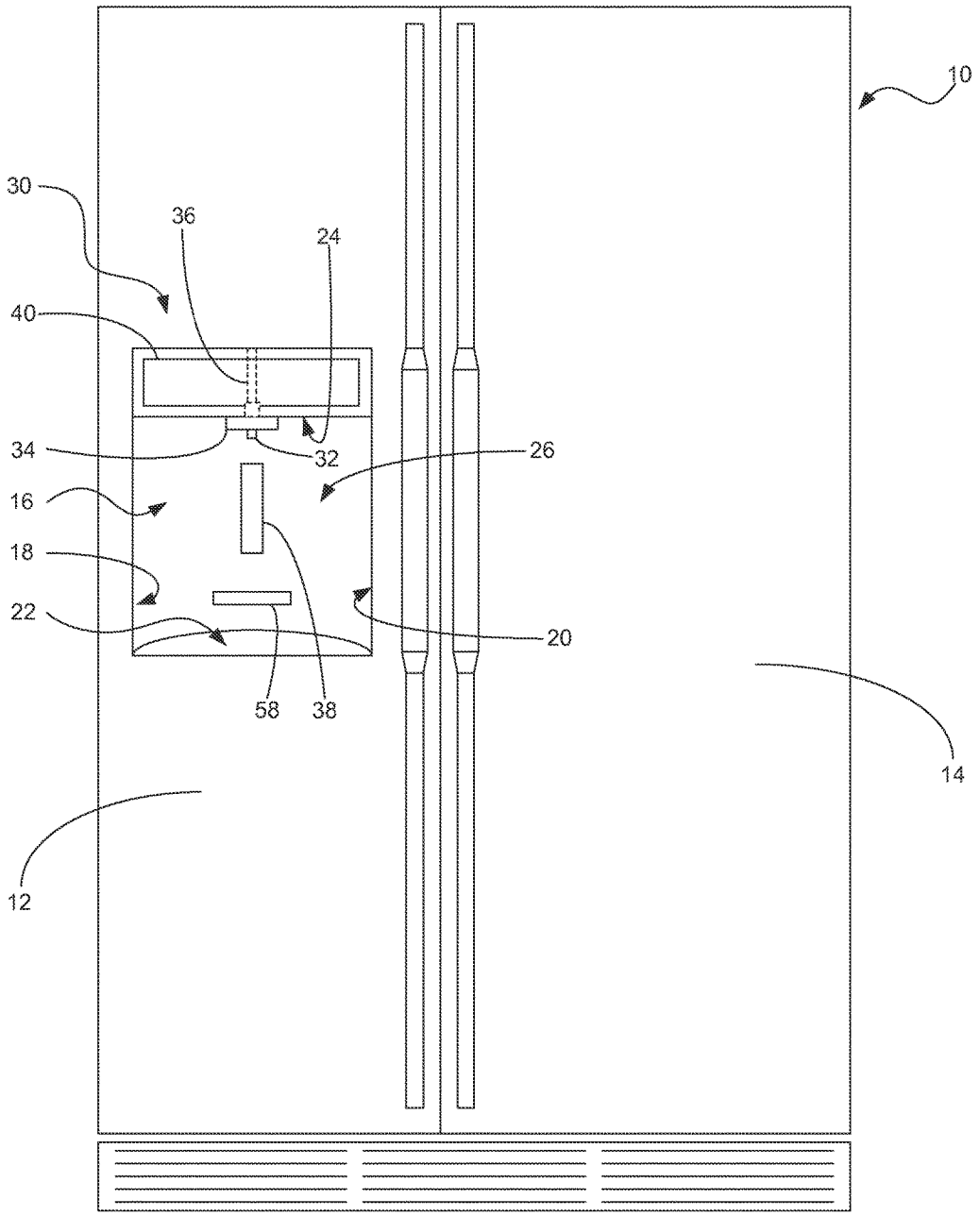
FIG. 1 is a front elevation view of an example refrigerator.

The present invention relates to refrigerators, and in particular to dispensers for refrigerators. The present invention will now be described with reference to the drawings, wherein like reference numerals are used to refer to like elements throughout. It is to be appreciated that the various drawings are not necessarily drawn to scale from one figure to another nor inside a given figure, and in particular that the size of the components are arbitrarily drawn for facilitating the understanding of the drawings. In the following description, for purposes of explanation, numerous specific details are set forth in order to provide a thorough understanding of the present invention. It may be evident, however, that the present invention can be practiced without these specific details. Additionally, other embodiments of the invention are possible and the invention is capable of being practiced and carried out in ways other than as described. The terminology and phraseology used in describing the invention is employed for the purpose of promoting an understanding of the invention and should not be taken as limiting.

Turning to the shown example of FIG. 1, a refrigeration apparatus in the form of a refrigerator 10 is illustrated as a side-by-side refrigerator with freezer and fresh food compartments. Conventional refrigeration appliances, such as domestic refrigerators, typically have both a fresh food compartment and a freezer compartment or section. The fresh food compartment is used to store non-frozen food items, such as fruits, vegetables, and beverages, and the freezer compartment is used to store frozen food items. The refrigerator includes a refrigeration system that maintains the fresh food compartment at temperatures above 0° C. and the freezer compartments at temperatures below 0° C.

The arrangement of the fresh food and freezer compartments with respect to one another can vary. For example, in some cases, the freezer compartment is located above the fresh food compartment (i.e., a top mount refrigerator), and in other cases the freezer compartment is located below the fresh food compartment (i.e. a bottom mount refrigerator). Additionally, many modern refrigerators have their freezer compartments and fresh food compartments arranged in a side-by-side relationship. Whatever arrangement of the freezer compartment and the fresh food compartment is employed, typically, separate access doors are provided for the compartments so that either compartment may be accessed without exposing the other compartment to the ambient air. For example, a door 12 provides access to the freezer compartment, and a door 14 provides access to the fresh food compartment of the refrigerator. Both of the doors are pivotally coupled to a cabinet of the refrigerator 10 to restrict and grant access to the fresh food and freezer compartments.

Located generally centrally at the surface or exterior of the door 12 is an example dispenser or dispensing apparatus indicated generally at 30. It is understood that the dispensing apparatus 30 could also be located at various locations on the refrigerator door or even inside the refrigerator. As can best be seen in FIG. 1, the dispensing apparatus 30 is located in a recess 16 in the door 12. The recess comprises side walls or surfaces 18 and 20 that are opposite one another, a bottom or lower wall or surface 22, an upper or top wall or surface 24 and a back or rear wall or surface 26. A water dispensing outlet 32 for dispensing cold water and an ice dispensing outlet 34 for dispensing ice are located at the upper surface 24 of the recess 16. In the shown embodiment of FIG. 1, the dispensing apparatus 30 can include a single dispensing outlet for the water 32 and ice 34 arranged so as to substantially coincide with one another at the upper surface 24 of the recess 16. However, in an alternative embodiment (not shown), a single dispensing outlet for water 32 and a single dispensing outlet for ice 34 can be arranged so as to be spaced apart from one another at the upper surface 24 of the recess 16 across the width of the access door 12 and not coincide with each other. The bottom surface 22 of the recess 16 can include a trough 62 (FIG. 2) for draining away excess water from the water dispensing outlet 32 and/or water formed from melting ice from the ice dispensing outlet 34 that comes to rest on the bottom surface 22.

Figure 2:
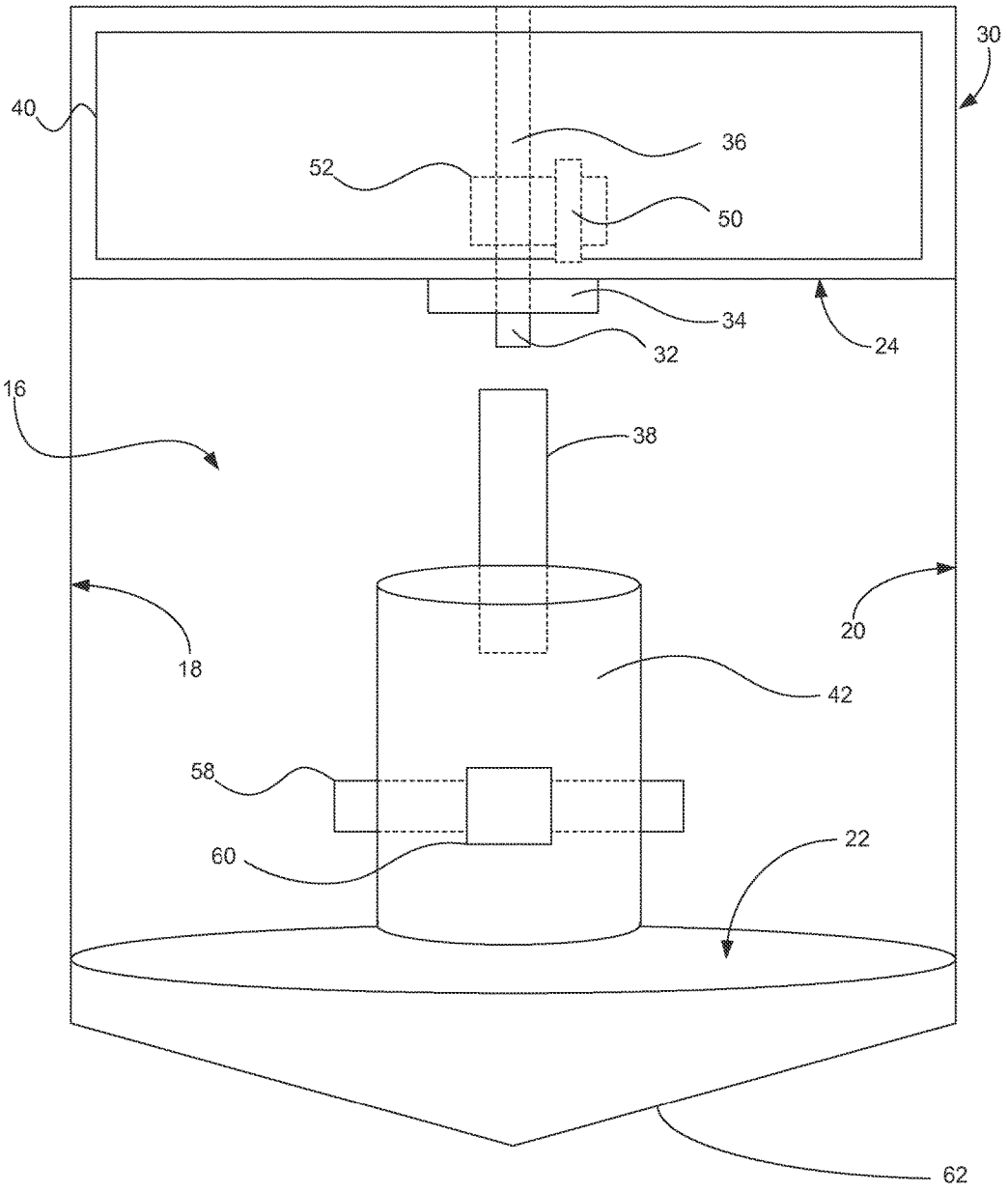
FIG. 2 schematically shows an example dispenser.

Turning to FIG. 2, at least one water line 36 is in communication with the dispenser 30 to supply water to the dispenser. The water line 36 extends from the water dispensing outlet 32 to a source of the water. The source of water can be, for example, a water reservoir connected to the household water supply system or the household water supply itself or such other sources as are familiar to those having ordinary skill in the art. A solenoid-operated valve 50 can be located along the water line 36 in fluid communication therewith, and can be controlled by a main controller 56 (FIG. 4) for the refrigerator. Though described as a solenoid-operated valve 50, other types of valves can be used, such as motor actuated valves or the like. Additionally, at least one water filter can be located in fluid communication with the at least one water line 36 to filter the incoming water.

Keeping with the shown example of FIG. 2, a trough 62 can be located below the water dispensing outlet 32 and the ice dispensing outlet 34. The trough 62 collects overflow content that is typically spilled or overflowed water or ice from the water dispensing outlet 32, ice dispensing outlet 34, and/or receiver vessel 42. The trough 62 can be part of the bottom surface 22 that supports the receiver vessel 42, or even below the bottom surface 22. The trough 62 can have a geometry configured to capture and retain the overflow content.

The ice dispensing outlet 34 includes an opening in the upper surface 24 of the recess 16. The opening is in communication with a source of ice such as, for example, the ice storage bin of an ice making unit (not shown) located in the fresh food or freezer compartment of the refrigerator. Typically, as is familiar to those of ordinary skill in the art, the ice is delivered from the ice storage bin to the ice dispensing outlet 34 by an auger 130 (FIG. 4) which upon activation rotates so as to drive the ice from the storage bin to the ice dispensing outlet 34. Activation of the auger 130 can be accomplished by the main controller that also controls the operation of a solenoid-operated valve 50 located in the water line 36, or by other control structure. The refrigerator 10 can further include an ice crusher 132 for crushing cubed ice as it is delivered to the dispenser.

At least one input device 38 can be operatively connected to a user interface controller 54 (FIG. 4), which is in turn connected to the main controller 56, and can be configured to dispense either or both of water from the water dispensing outlet 32 and ice from the ice dispensing outlet 34. The input device 38 can be a switch, button, paddle, or any other contact-style or non-contact-style means known in the art to manually operate a dispenser. For example, the input device 38 can be a paddle that is actuated by a receiver vessel (e.g., a cup) when the receiver vessel is placed into the dispenser. Alternatively, separate input devices (not shown) can be provided for each of the water dispensing outlet 32 and the ice dispensing outlet 34. Additionally or alternatively, dispensing functions can be controlled by the user interface controller 54 (FIG. 4), which can be appropriately programmed using information that is input by a user through a user interface 40 that is electrically connected to the user interface controller 54. The input device 38 and the user interface 54 are example dispense command inputs that can allow the user to provide dispense commands to the dispenser, allowing water and/or ice to be dispensed on-demand into the receiver vessel 42. Dispense commands allow the user to set various dispense parameters, such as the type of product to be dispensed (e.g., water, crushed ice, cubed ice), the amount to be dispensed, the temperature of the dispensed product, etc.

Additionally or alternatively, the dispensing apparatus can contain a code reader 58 that detects a receiver vessel 42 that is equipped with an identification tag 60. The code reader 58 interprets an identification code associated with the receiver vessel when the receiver vessel is located proximate the dispenser. The code reader 58 can be a radio frequency identification (RFID) reader, a bar code scanner, a QR code scanner, or any other mechanism known in the art that can identify a receiver vessel 42 when the receiver vessel 42 is placed in close proximity to the code reader 58. The code reader 58 is operatively connected to the user interface controller 54 to provide a vessel identification (ID) to the user interface controller, based on the interpreted identification code associated with the receiver vessel.

The user interface controller 54 (FIG. 4) is configured to receive inputs from the input device 38, the user interface 40, and the code reader 58, and communicates various information regarding a desired dispensing operation to the main controller 56, via serial communications for example. The main controller 56 then operates the solenoid-operated valve 50 and/or auger according to the inputs and/or information received. It can be seen in FIG. 4 that the user interface controller 54 and the main controller 56 can communicate bidirectionally, such as over a communications bus within the refrigerator.

The receiver vessel 42 includes an identification tag 60 that stores the identification code of the vessel. If the code reader 58 is a visual scanner such as a bar code scanner or QR code scanner, a bar code label or QR label is affixed to the exterior of the receiver vessel 42 in a manner that allows the bar code scanner or QR scanner to read the identification tag 60. If the code reader 58 is a RFID reader, then an RFID tag is affixed to the receiver vessel 42. The RFID tag does not need to be directly in the line of sight of the RFID reader and can be affixed anywhere on the receiver vessel 42, or inside the outer wall of the receiver vessel 42.

Each identification tag 60 corresponds to a unique receiver vessel identification number or code (vessel ID). Vessel IDs can be stored in a nonvolatile memory unit 46 (FIG. 4), for example on an EEPROM chip, located either on the main controller 56 or user interface controller 54. Each vessel ID corresponds with a specific receiver vessel 42. The usage parameters for each receiver vessel 42 are stored along with its corresponding vessel ID. When the code reader 58 detects a vessel ID, the system retrieves the stored usage parameters for that receiver vessel 42.

In one embodiment, the code reader 58 is an RFID reader and the identification tag 60 is a RFID tag. The RFID tag may either be read-only, having a factory-assigned serial number that is used as a key into a database, or may be read/write, where object-specific data can be written into the tag by the system user. Field programmable RFID tags may be write-once, read-multiple; "blank" tags may be written with an electronic product code by the user. The RFID tag stores a unique receiver vessel identification number. When the receiver vessel 42 is placed within range of the RFID reader, the vessel ID is read by the RFID reader. This vessel ID is then communicated to the user interface controller 54, which in turn can correlate the vessel ID number with stored usage parameters for the corresponding receiver vessel 42, or, alternatively, the user interface controller 54 can communicate the vessel ID to the main controller 56, which in turn will correlate the vessel ID number with the stored usage parameters.

In another embodiment, the code reader 58 is a bar-code scanner and the identification tags are bar-code labels. The bar-code labels are affixed to the receiver vessel 42 in a manner such that they are in a direct line of sight for the bar-code scanner. The bar-code scanner reads the bar-code label and communicates the vessel ID to the user interface controller 54. The user interface controller 54 can correlate the vessel ID with stored usage parameters for the corresponding receiver vessel 42, or, alternatively, the user interface controller 54 can communicate the vessel ID to the main controller 56, which in turn will correlate the vessel ID with the stored usage parameters for the corresponding receiver vessel 42.

In another embodiment, the code reader 58 is a QR scanner and the identification tags are QR labels. The QR labels are affixed to the receiver vessel 42 in a manner such that they are in a direct line of sight for the QR scanner. The QR scanner reads the QR label and communicates the vessel ID to the user interface controller 54. The user interface controller 54 can correlate the vessel ID with stored usage parameters for the corresponding receiver vessel 42, or, alternatively, the user interface controller 54 can communicate the vessel ID to the main controller 56, which in turn will correlate the vessel ID with the stored usage parameters for the corresponding receiver vessel 42.

The refrigerator 10 and/or dispenser 30 can be configured to remember any usage parameters that may be available for a dispensing operation. This can include, for example, parameters associated with content volume, content temperature, an amount of ice to be dispensed, beverage concentration for different types of liquids, beverage carbonation levels, preparation instructions, or other features available in dispensing apparatuses. The usage parameters are linked to a corresponding vessel ID for a receiver vessel, and stored in a nonvolatile memory unit 46, for example an EEPROM chip, accessible to the user interface controller 54 and/or the main controller 56.

In one example embodiment of the dispensing apparatus 30 equipped with a code reader 58, the first time a receiver vessel 42 having an identification tag 60 is used, the user places the receiver vessel 42 in the dispenser recess 16 and waits for the code reader 58 to read the identification code provided by the tag. The code reader 58 interprets the identification code and communicates the vessel ID to the user interface controller 54. The dispensing apparatus 30 can acknowledge the detection of a receiver vessel 42, and confirm the vessel ID to the user either audibly or visually through the user interface 40. The dispensing apparatus 30 can include pre-loaded default usage parameters, can require a user to manually entire the desired usage parameters through the user interface 40, or can allow the user to fill the receiver vessel 42 by manually manipulating the input device 38 while monitoring the volume of content manually dispensed. After the receiver vessel 42 has been filled for the first time, the usage parameters (e.g., volume of water dispensed, amount of ice dispensed, type of ice dispensed, such as crushed ice or cubed ice, etc.) are stored in the nonvolatile memory unit 46 in association with the vessel ID, and are retrieved each time the vessel ID for the corresponding receiver vessel 42 is detected. In this manner, the user teaches the dispensing apparatus 30 the desired usage parameters for the corresponding receiver vessel 42.

Upon receiving the vessel ID, the user interface controller 54 and/or the main controller 56 determines whether there has been a previous dispensing operation for the receiver vessel 42 (e.g., whether water and/or ice has been previously dispensed into the receiver vessel). When it is determined that there has not been a previous dispensing operation for the receiver vessel 42, the user interface controller 54 and/or the main controller 56 causes the usage parameter(s) to be stored in the nonvolatile memory unit 46, in association with the vessel ID, based on the dispense command or commands received from the user (e.g., the dispensing parameters input by the user through the input device 38 and/or the user interface 40). Thus, upon filling the receiver vessel 42 for the first time, the refrigerator will automatically record various usage parameters for the vessel, such as volume of water dispensed and quantity and type of ice dispensed. The refrigerator can recall the usage parameters recorded when the receiver vessel 42 was initially filled, and automatically refill the vessel according to the stored usage parameters when the receiver vessel is later brought to the dispenser.

For each subsequent use of the receiver vessel 42, the user moves the receiver vessel 42 into the dispenser recess 16. The code reader 58 reads and interprets the vessel ID of that receiver vessel 42 and communicates the vessel ID to the user interface controller 54. From the vessel ID, the user interface controller 54 and/or the main controller 56 can determine whether there has been a previous dispensing operation for the receiver vessel 42, based on the presence of stored usage parameters for the receiver vessel, a set flag in the nonvolatile memory unit 46, etc.

The dispensing apparatus 30 can acknowledge the detection of a receiver vessel 42, and confirm the vessel ID to the user either audibly or visually through the user interface 40. The stored usage parameters associated to that receiver vessel 42 are read and trigger the appropriate dispensing functions. In an embodiment, the dispensing apparatus 30 can be configured to automatically begin dispensing according to the stored usage parameters of the corresponding receiver vessel 42 immediately after detecting a vessel ID. In another example, the user can be given a period of time to interrupt and input different usage parameters, otherwise the stored usage parameters for the corresponding receiver vessel 42 will be selected and dispensing will occur according to the stored parameters. In yet another example, the dispensing apparatus 30 can be configured to require a user to confirm the stored usage parameters for the corresponding receiver vessel 42 before dispensing will begin. The stored usage parameters can be either displayed visually on the user interface 40, or recited audibly. The user can then confirm the usage parameters either by selecting the usage parameters via the user interface 40, or by audibly confirming the usage parameters. The user additionally has the option to fill the receiver vessel 42 by inputting the desired parameters into the user interface 40 or by manually manipulating the input device 38 to override the stored usage parameters. Overriding the stored usage parameters will result in new usage parameters being stored in the nonvolatile memory unit 46 for the receiver vessel 42.

If a dispensing operation is to be controlled according to the stored usage parameters for a receiver vessel, and the user initiates dispensing by manually manipulating the input device 38, the main controller 56 can be configured to automatically stop dispensing when the usage parameters are fulfilled. For example, the main controller 56 can automatically close the solenoid-operated valve 50 when the dispensing apparatus 30 has dispensed a volume corresponding to the stored volume parameter, regardless of whether the input device 38 is still actuated. If the input device 38 is a paddle that is actuated by the receiver vessel 42 to dispense water and/or ice, the main controller 56 can automatically stop the dispensing operation when the usage parameters (e.g., volume of water, quantity of ice, etc.) are fulfilled, regardless of whether or not the paddle remains actuated or pressed.

Figure 3:
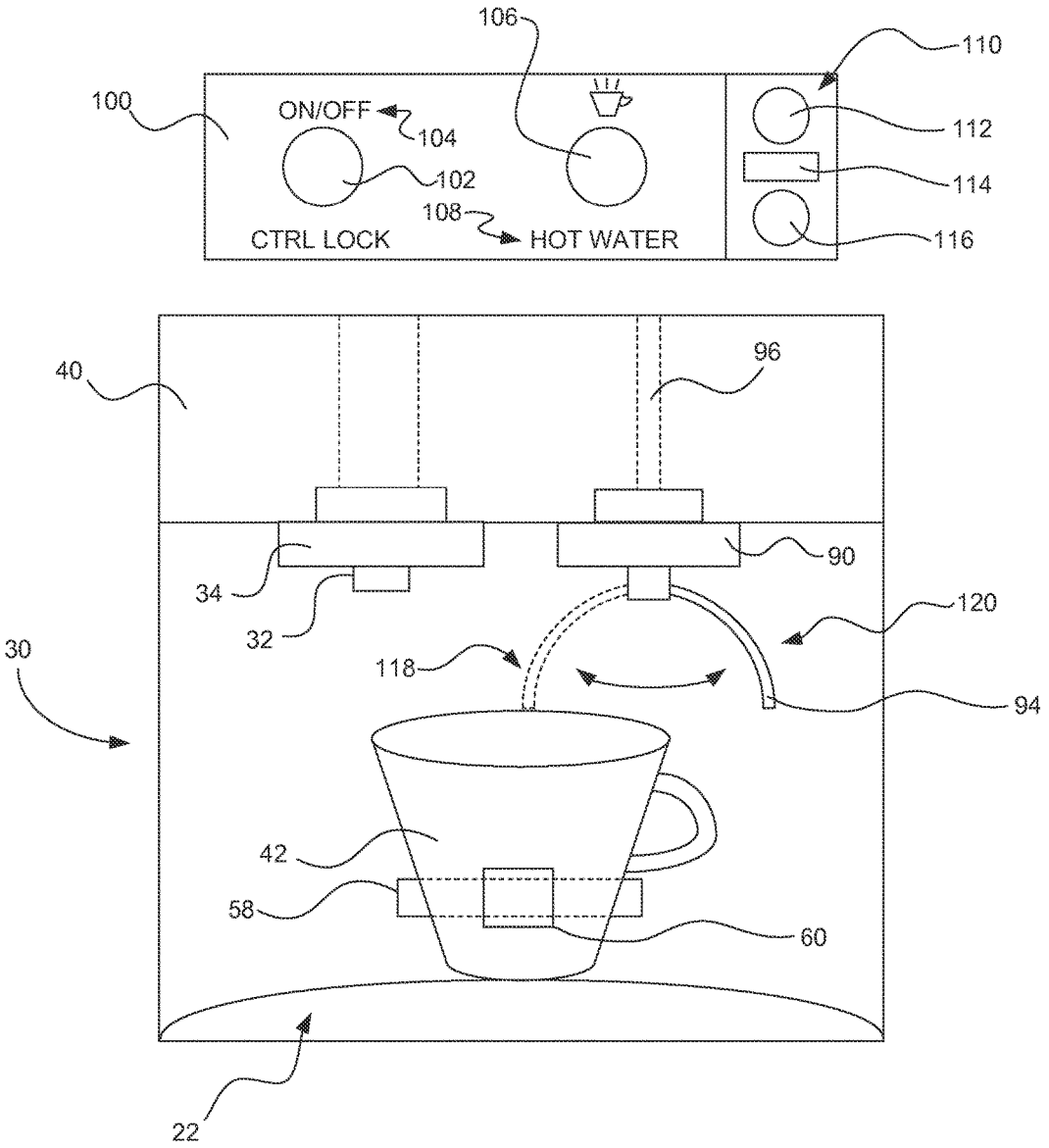
FIG. 3 schematically shows an example dispenser.

Turning to FIG. 3, the dispensing apparatus 30 can additionally include the ability to dispense water at a specific temperature. In this embodiment, the dispensing apparatus 30 can store usage parameters corresponding to at least content volume and content temperature. The example shown in FIG. 3 illustrates a dispensing apparatus 30 that includes a separate hot water dispenser 90 and hot water dispensing outlet 94. This example further depicts a separate hot water user interface 100, which includes a hot water activation switch 102, a hot water selection switch 106, visible indicia 104 and 108, and a temperature selection interface 110, which itself includes a temperature increase button 112, a temperature decrease button 116, and a selection button 114. It is contemplated that all available functionalities of the hot water user interface 100 can additionally or alternatively be included in the user interface display 40 (FIG. 2).

Continuing with the example of FIG. 3, the functionality and process for dispensing content into a receiver vessel 42 corresponds with any of the embodiments as described for FIG. 2, with the difference being the additional usage parameter of a content temperature setting being available for a user to select via the user interface display 40 or hot water user interface 100. After the initial use of a receiver vessel 42, the dispensing apparatus 30 stores a usage parameter corresponding to content temperature, and for each subsequent use, the dispensing apparatus 30 will either automatically begin dispensing according to the stored usage parameters including content temperature, allow a user to interrupt before dispensing begins, require a user to confirm the stored usage parameters prior to dispensing, or allow a user to manually override the usage parameters and input new usage parameters via the user interface display 40 or the hot water user interface 100.

In conjunction with any of the aforementioned example embodiments, each receiver vessel 42 can optionally have more than one usage profile. For example, in an embodiment where the dispensing apparatus 30 offers usage parameters of content volume and content temperature, a first usage profile for the corresponding receiver vessel 42 can be configured to dispense twelve ounces of water at a temperature of 38° F., and a second usage profile can be configured to dispense twelve ounces of water at a temperature of 145° F. This allows a user to utilize the same receiver vessel 42 for different uses, for example to have a cold glass of water and to have hot water for making coffee, tea, soup, etc. The specific values used in this example are solely for the purposes of illustrating the operation of multiple usage profiles and is not intended to be a limitation on the parameters that may be stored in a usage profile. The user can be prompted to confirm the usage profile either visually on the user interface display 40 or audibly. The user can then confirm the usage profile either by selecting the usage profile via the user interface display 40, or by audibly confirming the usage profile.

The refrigerator 10 or dispensing apparatus 30 can store any usage parameters that may be associated with a receiver vessel 42, but it is contemplated that the stored usage parameters include at least content volume. To ensure that the dispensing apparatus 30 accurately fills the receiver vessel 42 according to the stored content volume parameter, the dispensing apparatus 30 can further include a flow rate sensor 52 (FIG. 2, FIG. 4) that employs any of a variety of methods for measuring the volume of content dispensed, including at least one of a paddle-wheel, a turbine, a hot-wire anemometer, and any other suitable device for measuring the flow of liquid content. The flow rate sensor 52 can be located in the solenoid-operated valve 50, or anywhere in the series of components through which the flow of content can be measured.

In another embodiment in which the dispensing apparatus 30 is configured to store a content volume parameter for a corresponding receiver vessel 42, the dispensing apparatus 30 can measure the content volume by measuring the amount of time that the solenoid-operated valve 50 was open for the initial filling of the receiver vessel 42. For example, the dispensing apparatus 30 can measure the number of elapsed clock cycles of a microprocessor, beginning from the opening of the solenoid-operated valve 50 and ending when the solenoid-operated valve is closed 50.

Figure 4:
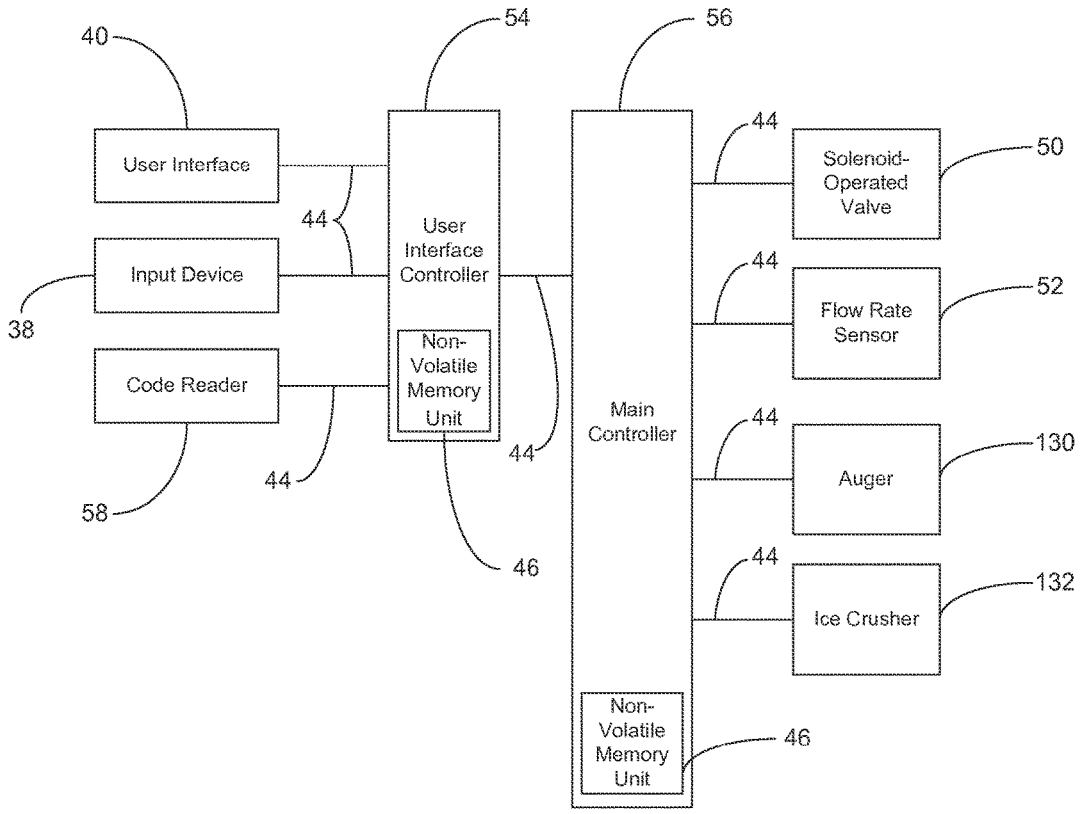
FIG. 4 is a schematic block diagram.

FIG. 4 provides a schematic block diagram of portions of a refrigerator having a dispensing apparatus. FIG. 4 shows a number of components that are in electrical communication 44 with one another. One of both of the user interface controller 54 and the main controller 56 can include the nonvolatile memory 46 discussed above. Further, the user interface controller 54 and the main controller 56 can be located on separate control circuit boards, or be part of a single controller for the entire refrigeration apparatus. Either controller can be an electronic controller and can include one or more processors. For example, a controller can include one or more of a microprocessor, a microcontroller, a digital signal processor (DSP), an application specific integrated circuit (ASIC), a field-programmable gate array (FPGA), discrete logic circuitry, or the like. Either controller can store program instructions that cause the controller to provide the functionality ascribed to it herein.

The user interface controller 54 is operatively connected to receive inputs from, and provide outputs to, the user interface 40 of the dispenser. The user interface controller 54 is also operatively connected to the input device 38 (e.g., a paddle switch) to receive inputs therefrom, and also operatively connected to the code reader 58 to receive the vessel ID.

The main controller 56 is operatively connected to the valve 50, the flow rate sensor 52, the auger 130 and the ice crusher 132, in addition to other controlled components (not shown) within the refrigerator. The main controller 54 can control the operations of the valve 50, the flow rate sensor 52, the auger 130 and the ice crusher 132 based on communications from the user interface controller 54. For example, the user interface controller 54 can inform the main controller 56 of a dispense command from a user, and the main controller 56 can dispense water and/or ice in strict accordance with the dispense command, or automatically based on the dispense command and stored usage parameters for a receiver vessel as discussed above. The main controller 56 can control the operations of the solenoid-operated valve 50, the auger 130 and the ice crusher 132 directly, or through interposing relays or electronic switches (e.g., power transistors). The main controller 56 can utilize inputs received from the flow rate sensor 52 and the user interface controller 54 to determine when to close the valve 50 and/or stop the auger 130, thus terminating the dispensing of content.

Figure 5:
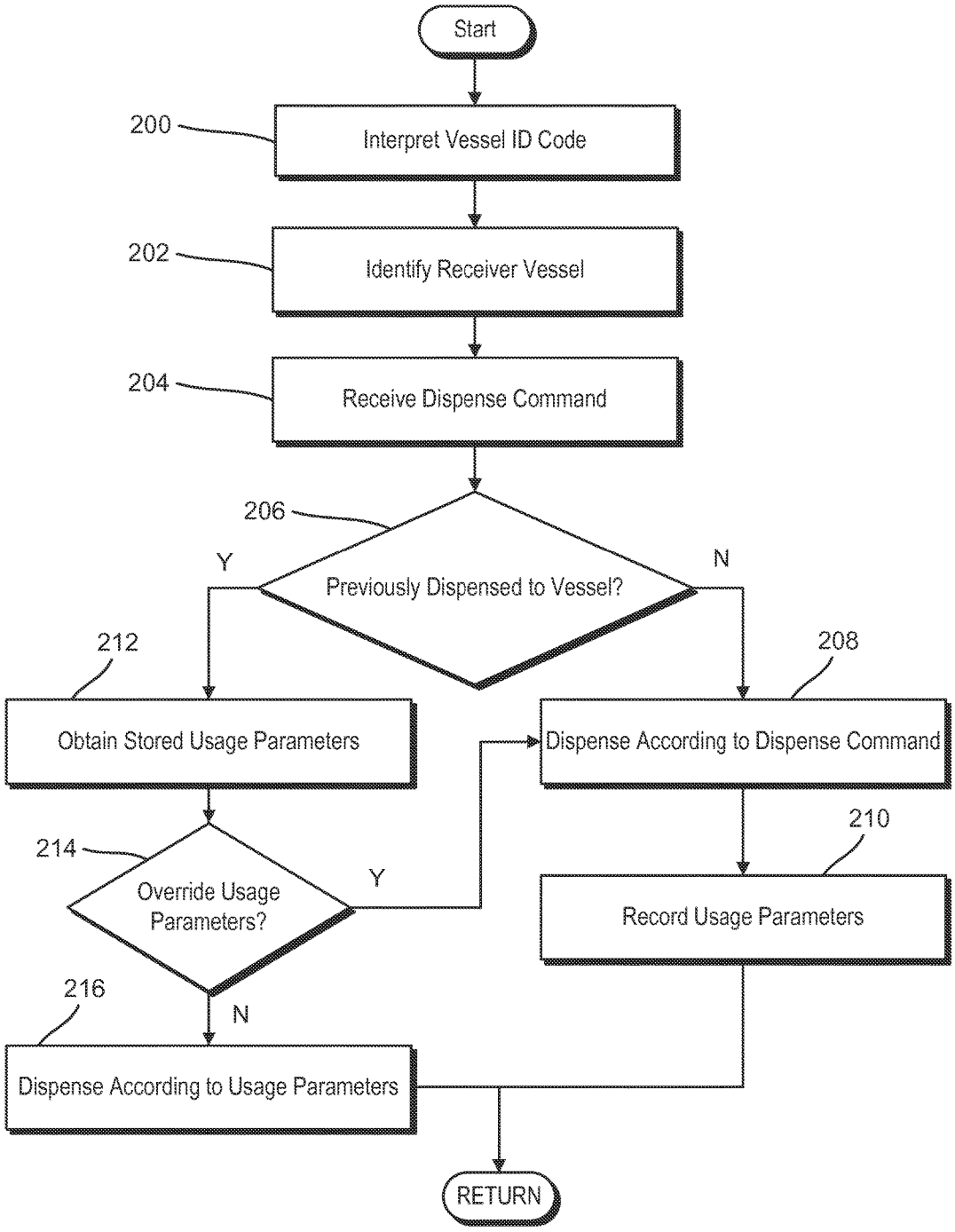
FIG. 5 is a flow diagram.

FIG. 5 is a flow diagram showing an example dispensing process and various steps within that process. To begin the dispensing process, a user would move a receiver vessel having an identification tag into the dispenser recess. The code reader on the dispenser receives the ID code from the tag, for example by scanning the tag or by receiving a transmission from the tag. The dispenser then interprets the ID code (step 200) and identifies the receiver vessel (step 202). The dispenser will receive a dispense command from the user (step 204). The dispense command can be input, for example, by depressing a paddle on the dispenser or by operating input devices on the user interface of the dispenser. The user can input the dispense command for an arbitrary length of time that corresponds to a desired volume of water or quantity of ice to be dispensed. For example, the user can keep the paddle depressed until the receiver vessel is filled with water, with the dispenser dispensing water the entire time the paddle is depressed, or for a portion of the time that the paddle is depressed. The refrigerator automatically determines whether the dispenser has previously dispensed contents into the receiver vessel (step 206). If the dispenser has not previously dispensed contents into the receiver vessel, the dispenser dispenses according to the dispense command (step 208), and stores the corresponding usage parameters (e.g., volume dispensed, length of time the paddle was depressed, etc.) and the vessel ID in memory (step 210). If the dispenser has previously dispensed contents into the receiver vessel, the dispenser obtains stored usage parameters for the receiver vessel from the memory (step 212). The dispenser can then determine whether the user wishes to override the usage parameters (step 214), such as by receiving a particular input from the user before automatically dispensing, or by requiring the user to confirm that the usage parameters are to be used. If the user wishes to override the usage parameters, the dispenser will dispense according to a dispense command received from the user (step 208), and store new usage parameters for the receiver vessel in the memory (step 210). If the user does not override the usage parameters, then the dispenser automatically dispenses content to the receiver vessel in accordance with the stored usage parameters (step 216).

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. A refrigeration apparatus, comprising:

a fresh food compartment;

a freezer compartment;

a dispenser configured to dispense at least one of water and ice into a receiver vessel, wherein the dispenser comprises:

a dispense command input configured to receive a dispense command from a user; and a code reader configured to interpret an identification code associated with the receiver vessel when the receiver vessel is located proximate the dispenser;

at least one controller operatively connected to the dispense command input to thereby receive the dispense command, and operatively connected to the code reader to thereby receive a vessel identification from the code reader based on the interpreted identification code, wherein the at least one controller controls a dispensing of the at least one of water and ice; and a memory operatively connected to the controller and configured to store the vessel identification in association with a usage parameter for the receiver vessel, wherein the at least one controller determines, by inquiring whether the vessel identification is already stored in the memory, whether the at least one of water and ice has been previously dispensed into the receiver vessel, and when the at least one controller has determined that the at least one of water and ice has not been previously dispensed into the receiver vessel, the at least one controller causes the usage parameter to be stored in the memory, in association with the vessel identification, based on a first dispense command received from the user that dispenses the at least one of water and ice into the receiver vessel, wherein the at least one controller is configured to automatically control the dispensing in accordance with the stored usage parameter for the receiver vessel upon determining that the at least one of water and ice has been previously dispensed into the receiver vessel, wherein the dispense command input comprises a user interface for overriding the stored usage parameter and the automatic control by the at least one controller, wherein the at least one controller is configured to cause a new usage parameter to be stored in the memory, in association with the vessel identification, based on the overriding, wherein the dispense command input comprises a paddle that is actuated by the receiver vessel when the receiver vessel is placed into the dispenser, and the usage parameter includes a volume of water that is manually dispensed into the receiver vessel when water has not been previously dispensed into the receiver vessel, and wherein when the at least one controller has determined that water has been previously dispensed into the receiver vessel, the at least one controller controls the dispenser to automatically dispense the volume of water included in the usage parameter.

2. The refrigeration apparatus of claim 1, wherein the usage parameter includes a temperature setting that is manually input via the user interface, and wherein when the at least one controller has determined that water has been previously dispensed into the receiver vessel, the at least one controller controls the dispenser to automatically dispense water at the temperature setting included in the usage parameter.

3. The refrigeration apparatus of claim 1, wherein, after the volume of water included in the usage parameter is automatically dispensed, the at least one controller causes the dispenser to automatically stop dispensing water while the paddle remains actuated by the receiver vessel.

4. The refrigeration apparatus of claim 1, wherein the usage parameter further includes an amount of ice, and when the at least one controller has determined that water has been previously dispensed into the receiver vessel, the at least one controller controls the dispenser to automatically dispense the amount of ice included in the usage parameter.

5. A refrigeration apparatus, comprising:

a fresh food compartment;

a freezer compartment;

a dispenser configured to dispense at least one of water and ice into a receiver vessel, wherein the dispenser comprises:

a dispense command input configured to receive a dispense command from a user; and a code reader configured to interpret an identification code associated with the receiver vessel when the receiver vessel is located proximate the dispenser;

at least one controller operatively connected to the dispense command input to thereby receive the dispense command, and operatively connected to the code reader to thereby receive a vessel identification from the code reader based on the interpreted identification code, wherein the at least one controller controls a dispensing of the at least one of water and ice; and a memory operatively connected to the controller and configured to store the vessel identification in association with a usage parameter for the receiver vessel, wherein the at least one controller determines, by inquiring whether the vessel identification is already stored in the memory, whether the at least one of water and ice has been previously dispensed into the receiver vessel, and when the at least one controller has determined that the at least one of water and ice has not been previously dispensed into the receiver vessel, the at least one controller causes the usage parameter to be stored in the memory, in association with the vessel identification, based on a first dispense command received from the user that dispenses the at least one of water and ice into the receiver vessel, wherein the at least one controller is configured to automatically control the dispensing in accordance with the stored usage parameter for the receiver vessel upon determining that the at least one of water and ice has been previously dispensed into the receiver vessel, wherein the dispense command input comprises a user interface for overriding the stored usage parameter and the automatic control by the at least one controller, wherein the at least one controller is configured to cause a new usage parameter to be stored in the memory, in association with the vessel identification, based on the overriding, and wherein when the at least one controller has determined that the at least one of water and ice has been previously dispensed into the receiver vessel, the user interface prompts the user to confirm that the dispensing is to be automatically controlled in accordance with the stored usage parameter for the receiver vessel.

6. A refrigeration apparatus, comprising:

a fresh food compartment;

a freezer compartment;

a dispenser configured to dispense water into a receiver vessel, wherein the dispenser comprises:

a dispense command input configured to receive a dispense command from a user; and a code reader configured to interpret an identification code associated with the receiver vessel when the receiver vessel is located proximate the dispenser;

a first controller operatively connected to the dispense command input to thereby receive the dispense command, and operatively connected to the code reader to thereby receive a vessel identification from the code reader based on the interpreted identification code;

a water line in communication with the dispenser to supply the water to the dispenser;

a valve located along the water line;

a second controller capable of bidirectional communications with the first controller, and operatively connected to the valve to control operations of the valve; and a memory operatively connected to either the first controller or the second controller and configured to store the vessel identification in association with a usage parameter for the receiver vessel, the usage parameter including a volume;

wherein:

either the first controller or the second controller determines, by inquiring whether the vessel identification is already stored in the memory, whether water has been previously dispensed into the receiver vessel, and when either the first controller or the second controller has determined that water has not been previously dispensed into the receiver vessel, either the first controller or the second controller causes the usage parameter to be stored in the memory, in association with the vessel identification, based on a first volume of water manually dispensed into the receiver vessel using a manually-entered command into the dispense command input, wherein the second controller is configured to automatically control the operations of the valve to dispense the volume of water included in the usage parameter, when either the first controller or the second controller has determined that water has been previously dispensed into the receiver vessel, wherein the dispense command input comprises a user interface, operatively connected to the first controller, for overriding the stored usage parameter and the automatic control by the second controller, and wherein either the first controller or the second controller is configured to cause a new usage parameter to be stored in the memory, in association with the vessel identification, based on the overriding.

7. The refrigeration apparatus of claim 6, wherein the dispense command input comprises a paddle that is actuated by the receiver vessel when the receiver vessel is placed into the dispenser, the user interface allowing the user to set a temperature of the water, wherein the usage parameter includes a temperature setting manually input via the user interface, and stored when either the first controller or the second controller determined that water had not been previously dispensed into the receiver vessel, and wherein when either the first controller or the second controller has determined that water has been previously dispensed into the receiver vessel, the volume of water included in the usage parameter is automatically dispensed at the temperature setting.

8. The refrigeration apparatus of claim 6, wherein the dispense command input comprises a paddle that is actuated by the receiver vessel when the receiver vessel is placed into the dispenser, and wherein when either the first controller or the second controller has determined that water has been previously dispensed into the receiver vessel, the second controller automatically controls the operations of the valve to dispense the volume of water included in the usage parameter, and after the volume of water included in the usage parameter is automatically dispensed, the second controller automatically shuts the valve to stop dispensing water while the paddle remains actuated by the receiver vessel.

9. The refrigeration apparatus of claim 6, wherein the refrigeration apparatus further comprises an auger for dispensing ice, wherein the usage parameter further includes an amount of ice, and when either the first controller or the second controller has determined that water has been previously dispensed into the receiver vessel, the second controller controls the auger to automatically dispense the amount of ice included in the usage parameter.

10. The refrigeration apparatus of claim 6, wherein when either the first controller or the second controller has determined that water has been previously dispensed into the receiver vessel, the user interface prompts the user to confirm that dispensing is to be automatically controlled in accordance with the stored usage parameter for the receiver vessel.

11. The refrigeration apparatus of claim 6, wherein the code reader comprises at least one of an RFID reader, a bar-code scanner, and a QR code scanner.

* * * * *